US007240967B2

(12) United States Patent
Wade

(10) Patent No.: US 7,240,967 B2
(45) Date of Patent: Jul. 10, 2007

(54) MODULAR FURNITURE SYSTEM

(75) Inventor: Donald L. Wade, Goshen, IN (US)

(73) Assignee: Weiland Designs, Inc., Goshen, IN (US)

( * ) Notice: Subject to any disclaimer, the term of this patent is extended or adjusted under 35 U.S.C. 154(b) by 327 days.

(21) Appl. No.: 10/893,624

(22) Filed: Jul. 16, 2004

(65) Prior Publication Data

US 2006/0103220 A1 May 18, 2006

Related U.S. Application Data

(60) Provisional application No. 60/561,729, filed on Apr. 13, 2004.

(51) Int. Cl.
*A47C 7/00* (2006.01)

(52) U.S. Cl. ..... 297/440.1; 297/440.23

(58) Field of Classification Search ..... 297/440.1, 297/440.16, 440.21, 440.23
See application file for complete search history.

(56) References Cited

U.S. PATENT DOCUMENTS

| | | | | | |
|---|---|---|---|---|---|
| 1,278,491 | A | | 9/1918 | Metzger | |
| 2,605,820 | A | | 8/1952 | Powellek | |
| 3,036,864 | A | * | 5/1962 | Arai | 297/463.1 |
| 3,171,690 | A | * | 3/1965 | Weiss | 297/440.23 |
| 3,608,959 | A | * | 9/1971 | Sarvas | 297/218.3 |
| 3,973,800 | A | | 8/1976 | Kogan | |
| 3,989,298 | A | * | 11/1976 | Cycowicz et al. | 297/342 |
| 4,395,071 | A | | 7/1983 | Laird | |
| 4,519,645 | A | * | 5/1985 | Kelly et al. | 296/224 |
| 4,602,817 | A | | 7/1986 | Raftery | |
| 5,000,512 | A | * | 3/1991 | Laird | 297/440.1 |
| 5,169,211 | A | * | 12/1992 | Inaba et al. | 297/440.16 |
| 5,184,871 | A | * | 2/1993 | LaPointe et al. | 297/440.21 |
| 5,352,017 | A | | 10/1994 | Berning | |
| 5,518,298 | A | * | 5/1996 | LaPointe et al. | 297/463.1 |
| 5,551,757 | A | * | 9/1996 | Glover | 297/440.23 |
| 5,738,414 | A | | 4/1998 | Wieland et al. | |
| 5,795,028 | A | | 8/1998 | Dussia, Jr. et al. | |
| 5,890,767 | A | | 4/1999 | Chang | |
| 5,931,529 | A | | 8/1999 | LaPointe et al. | |
| 6,241,317 | B1 | | 6/2001 | Wu | |
| 6,367,880 | B1 | * | 4/2002 | Niederman et al. | 297/440.14 |
| 6,422,654 | B1 | | 7/2002 | Grove | |
| 6,692,079 | B2 | * | 2/2004 | Guillot | 297/452.18 |
| 6,796,614 | B1 | * | 9/2004 | Paul | 297/440.14 |
| 2003/0111882 | A1 | | 6/2003 | Niederman et al. | |

* cited by examiner

*Primary Examiner*—David Dunn
*Assistant Examiner*—Sarah B. McPartlin
(74) *Attorney, Agent, or Firm*—Trexler, Bushnell, Giangiorgi, Blackstone & Marr, Ltd.

(57) ABSTRACT

A modular furniture system is provided which allows an article of furniture to be "knocked down" into components and shipped. Upon reaching its destination, if desired, the article can be easily assembled without using tools. The components include a chassis, a back and end sections. The chassis includes upwardly extending blades which engage the back and end sections. The back and end sections include cams which are rotated to engage the chassis. When the cams are rotated to their locked positions, the blades are flexed away from the chassis to provide an interference fit between the chassis and the components.

4 Claims, 13 Drawing Sheets

228, 177
257
256
253
254
252
251
250
255

177, 228
250
252
254

254
253
250
251a
251
251b 177, 228
254
252

177, 228

MODULAR FURNITURE SYSTEM

This application claims the benefit of U.S. provisional application Ser. No. 60/561,729, filed on Apr. 13, 2004.

BACKGROUND OF THE INVENTION

Modular furniture is desirable in that it can be "knocked down" into components prior to shipment of the components. Because the components can be shipped more compactly than fully assembled furniture. Thus, shipping costs associated with modular furniture is typically less expensive than shipping costs associated with fully assembled furniture.

Although modular furniture has been provided in the past, assembly of such modular furniture is often difficult.

The present invention provides a modular furniture system which overcomes the problems presented in the prior art and which provides additional advantages over the prior art, such advantages will become clear upon a reading of the attached specification in combination with a study of the drawings.

OBJECTS AND SUMMARY OF THE INVENTION

A general object of the present invention is to provide a modular furniture system which allows the furniture components to be compactly shipped.

An object of the present invention is to provide a modular furniture system which can be easily assembled.

A specific object of the present invention is to provide a modular furniture system which can be assembled without the use of tools.

Another object of the present invention is to provide a modular furniture system for which components can be easily replaced.

Briefly, and in accordance with the foregoing, the present invention discloses a modular furniture system generally including a chassis, a back frame, and end sections. The chassis includes upwardly extending blades which mate with the back frame and end sections and cams for securing the back and end sections to the chassis. Assembly of the components does not require the use of tools.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 6*a* is an enlarged view of a portion of FIG. 6

DETAILED DESCRIPTION OF THE ILLUSTRATED EMBODIMENTS

Figure 1:
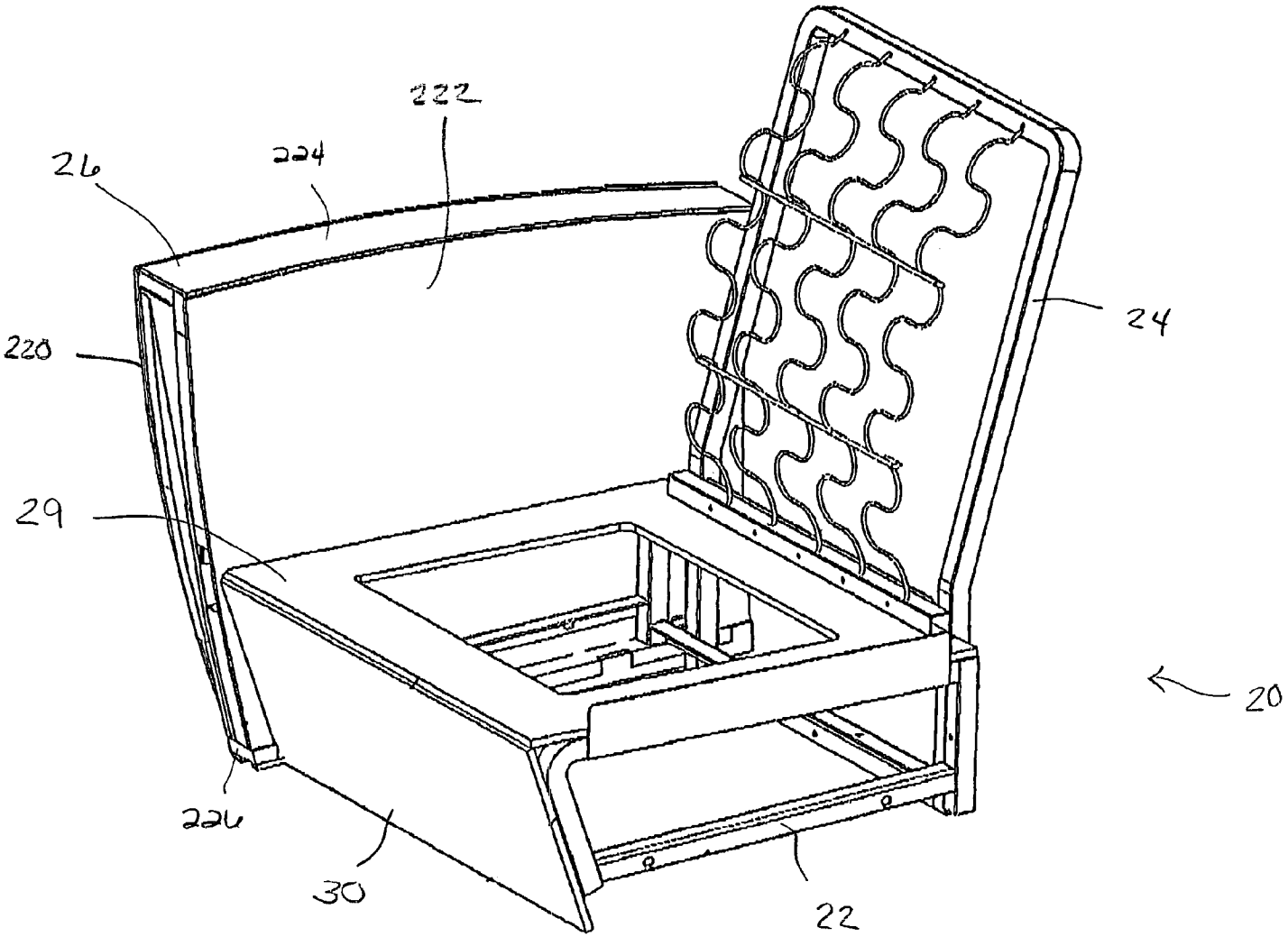
FIG. 1 is a perspective view of a portion of the modular system of the present invention which incorporates the features of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

For the purposes of the description provided the terms, left, right, front and rear shall refer to positions relative to a user seated on the furniture described.

The modular furniture system shown in FIG. 1 forms a chair 20. The chair 20 includes a chassis 22, a back frame 24, a right end section 26, a left end section (see FIG. 8), a seat platform 29, and a kick plate 30.

Figure 2:
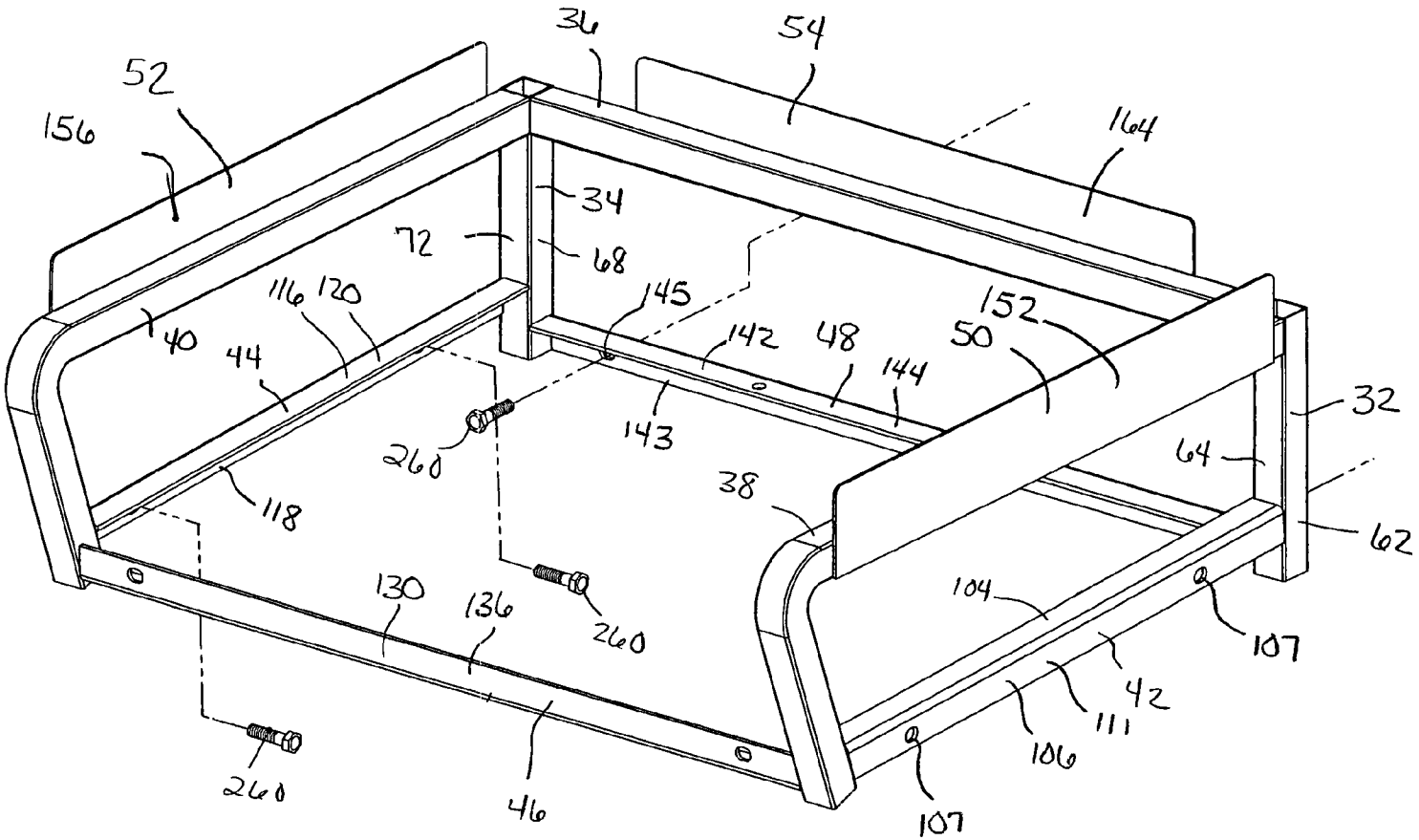
FIG. 2 is a perspective view of the chassis of the modular system of FIG. 1.
Figure 2A:
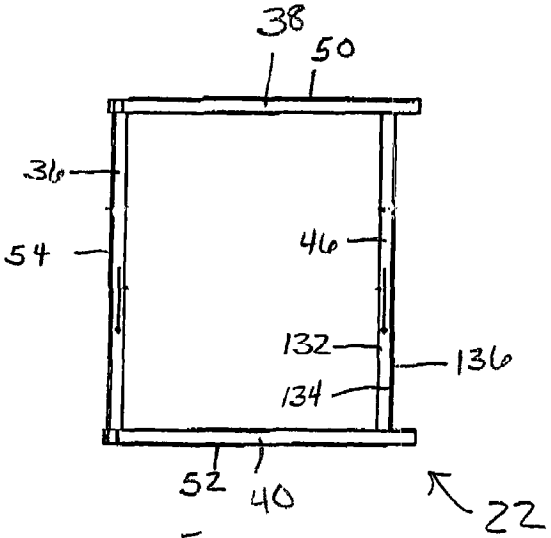
FIG. 2*a* is a top plan view of the chassis of FIG. 2.
Figure 3:
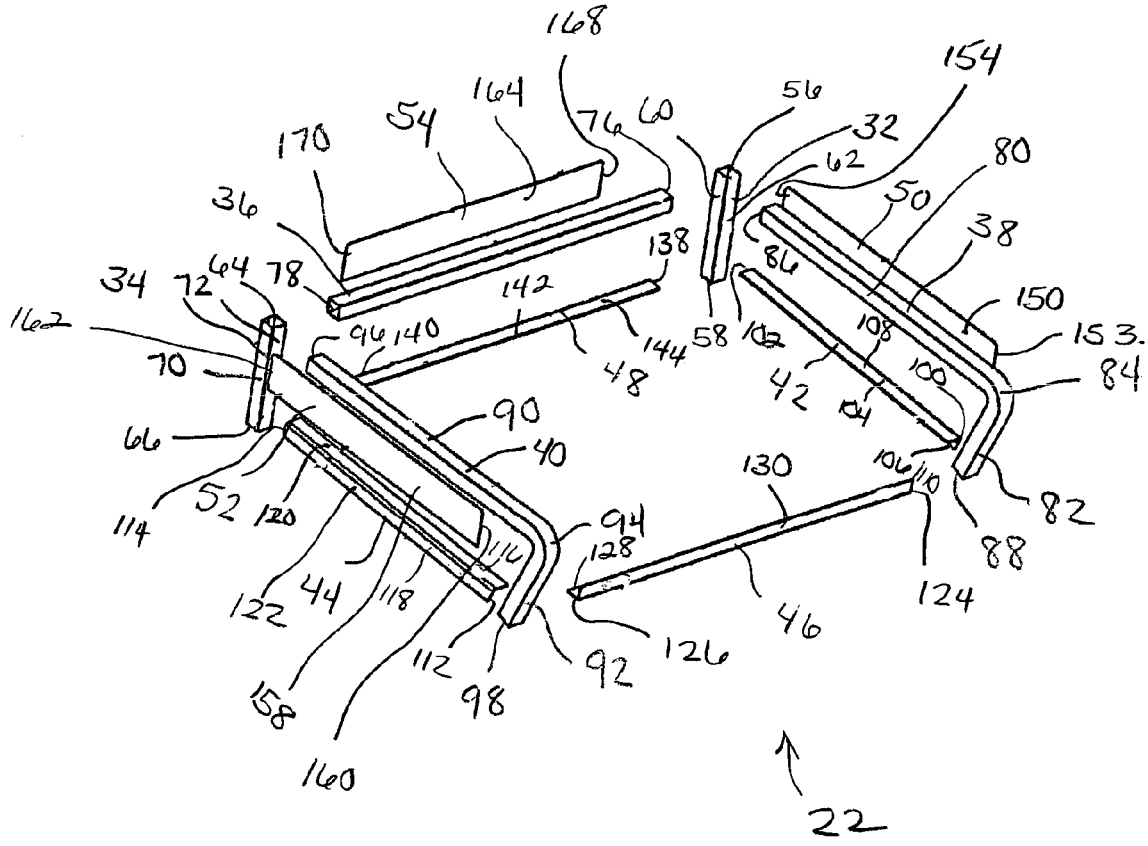
FIG. 3 is an exploded perspective view of the chassis of FIG. 2.

As shown in FIGS. 2-3, the chassis includes a left corner post 32, a right corner post 34, a back rail 36, a left side rail 38, a right side rail 40, a left base 42, a right base 44, a front base 46, a rear base 48, a left side blade 50, a right side blade 52, and a rear blade 54.

Figure 2C:
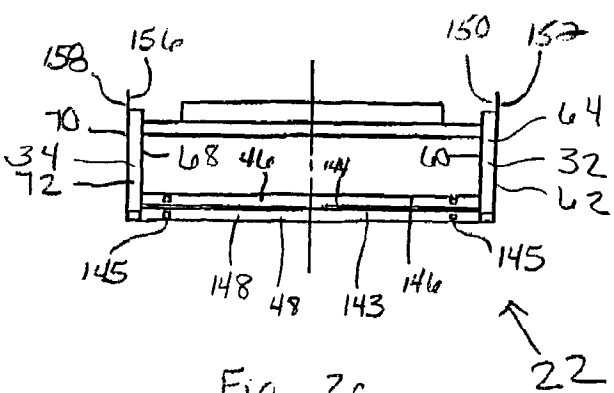
FIG. 2*c* is a front elevational view of the chassis of FIG. 2.

The left corner post 32 is generally elongated and vertical. The left corner post 32 is formed from tubular metal which has a square cross-section. The left corner post 32 includes an upper end 56 and a lower end 58. The left corner post 32 includes an inner surface 60, an outer surface 62, a front surface 64 (see FIG. 2*c*) and a rear surface 65 (see FIG. 7).

Figure 2B:
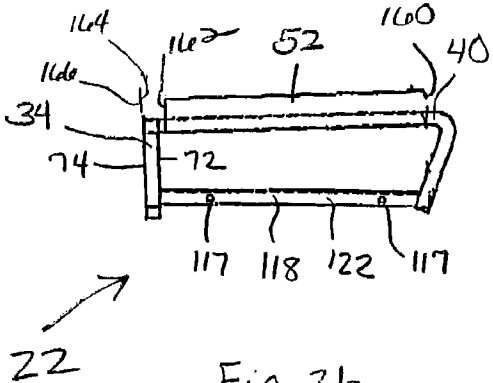
FIG. 2*b* is a right end view of the chassis of FIG. 2.

The right corner post 34 is generally elongated and vertical. The right corner post 34 is formed from tubular metal which has a square cross-section. The right corner post 34 includes an upper end 64 and a lower end 66. The right corner post 34 includes an inner surface 68, an outer surface 70, a front surface 72, and a rear surface 74 (see FIG. 2*b*).

The back rail 36 is generally elongated and includes a left end 76 and a right end 78. Preferably, the back rail 36 is formed from tubular metal which has a square cross-section. The left end 76 of the back rail 36 is attached to the left corner post 32 proximate the upper end 56 thereof. The back rail 36 is attached to the left corner post 32 preferably by welding the left end 76 of the back rail 56 to the inner surface 60 of the left corner post 32. The right end 78 of the back rail 36 is attached to the right corner post 34 proximate the upper end 64 thereof. The back rail 36 is attached to the right corner post 34 preferably by welding the right end 78 of the back rail 36 to the inner surface 68 of the right corner post 34.

The left side rail 38 is generally L-shaped and includes a generally horizontal portion 80 and a generally vertical portion 82 extending downwardly from the horizontal portion 80. A rounded corner 84 is provided between the horizontal portion 80 and the vertical portion 82. The left side rail 38 includes a rear end 86 and a lower end 88. Preferably, the left side rail 38 is formed from tubular metal which has a square cross-section. The rear end 86 of the left side rail 38 is attached to the front surface 64 of the left corner post 32, preferably by welding. The horizontal portion 80 of the left side rail 38 is generally perpendicular to the left corner post 32. The left side rail 38 extends forwardly from the front surface 64 of the left corner post 32.

The right side rail 40 is generally L-shaped and includes a generally horizontal portion 90 and a generally vertical portion 92 extending downwardly from the horizontal portion 90. A rounded corner 94 is provided between the horizontal portion 90 and the vertical portion 92. The right side rail 40 includes a rear end 94 and a lower end 98. Preferably, the right side rail 40 is formed from tubular metal which has a square cross-section. The rear end 96 of the right side rail 40 is attached to the front surface 72 of the right corner post 34, preferably by welding. The horizontal portion 90 of the right side rail 40 is generally perpendicular to the right corner post 34. The right side rail 40 extends forwardly from the front surface 72 of the right corner post 34.

The left base 42 is generally elongated and has a front end 100 and a rear end 102. The left base 42 is preferably formed from metal and has an L-shaped cross-section. As best shown in FIG. 6*b*, the left base 42 generally includes a horizontal portion 104 and a vertical portion 106 perpendicular to the horizontal portion 104. The horizontal portion 104 includes an upper surface 108 and a lower surface 109. The vertical portion 106 includes an inner surface 110 and an outer surface 111. Mounting apertures 107 are provided through the vertical portion 106 of the left base 42. The left base 42 extends from the front surface 64 of the left corner post 32 to the vertical portion 82 of the left side rail 38 proximate the lower end 88 thereof. Preferably, the left base 42 is welded to the left corner post 32 and the left side rail 38.

The right base 44 is generally elongated and has a front end 112 and a rear end 114. The right base 40 is preferably formed from metal and has an L-shaped cross-section. The right base 40 generally includes a horizontal portion 116 and a vertical portion 118 perpendicular to the horizontal portion 116. The horizontal portion 116 includes an upper surface 120 and a lower surface 121 (see FIG. 7) and the vertical portion 118 includes an inner surface 119 and an outer surface 122. Mounting apertures 117 are provided through the vertical portion 118 of the right base 44. The right base 44 extends from the front surface 72 of the right corner post 34 to the vertical portion 92 of the right side rail 40 proximate the lower end 98 thereof. Preferably, the right base 44 is welded to the right corner post 34 and the right side rail 40.

The front base 46 is generally elongated and has a left end 124 and a right end 126. The front base 46 is preferably formed from metal and has an L-shaped cross-section. The front base 46 includes a horizontal portion 128 and a vertical portion 130 (see FIG. 7). The horizontal portion 128 includes an upper surface 132 and a lower surface 133 and the vertical portion 130 includes an inner surface 134 and an outer surface 136. The front base 46 extends from the inner surface of the left side rail 38, proximate the lower end 88 thereof, to the inner surface of the right side rail 40, proximate the lower end 98 thereof. The front base 46 is attached to the left and right side rails 38, 40 preferably by welding.

The rear base 48 is generally elongated and has a left end 138 and right end 140. The rear base 48 is preferably formed from metal and has an L-shaped cross-section. The rear base 48 includes a horizontal portion 142 and a vertical portion 143. The horizontal portion 142 includes an upper surface 144 and a lower surface 146 and the vertical portion includes an inner surface 148 and an outer surface 149 (see FIG. 7). Mounting apertures 145 are provided through the vertical portion 143. The rear base 48 extends from the inner surface 60 of the left corner post 32, proximate the lower end 58 thereof, to the inner surface 68 of the right corner post 34, proximate the lower end 66 thereof.

The left blade 50 is generally elongated and includes an inner surface 150 and an outer surface 152. The left blade also include a front end 153 and a rear end 154. The left blade 50 extends upwardly from the horizontal portion 80 of the left side rail 38. The left blade 50 is mounted to the outer surface of the horizontal portion 80 of the left side rail 38 preferably by welding a portion of the inner surface 150 of the left side blade 50 to the outer surface of the horizontal portion 80 of the left side rail 38.

The right blade 52 is generally elongated and includes an inner surface 156 and an outer surface 158. The right blade also includes a front end 160 and a rear end 162. The right blade 52 extends upwardly from the horizontal portion 90 of the right side rail 40. The right blade 52 is mounted to the outer surface of the horizontal portion 90 of the right side rail 40, preferably by welding the inner surface 156 of the right side blade 52 to the outer surface of the horizontal portion 90 of the right side rail 40.

The rear blade 54 is generally elongated and includes an inner surface 164 and an outer surface 166. The rear blade 54 also includes a left end 168 and a right end 170. The rear blade 54 extends upwardly from the rear surface of the back rail 36 and is preferably attached to the back rail 36 by welding.

Figure 6:
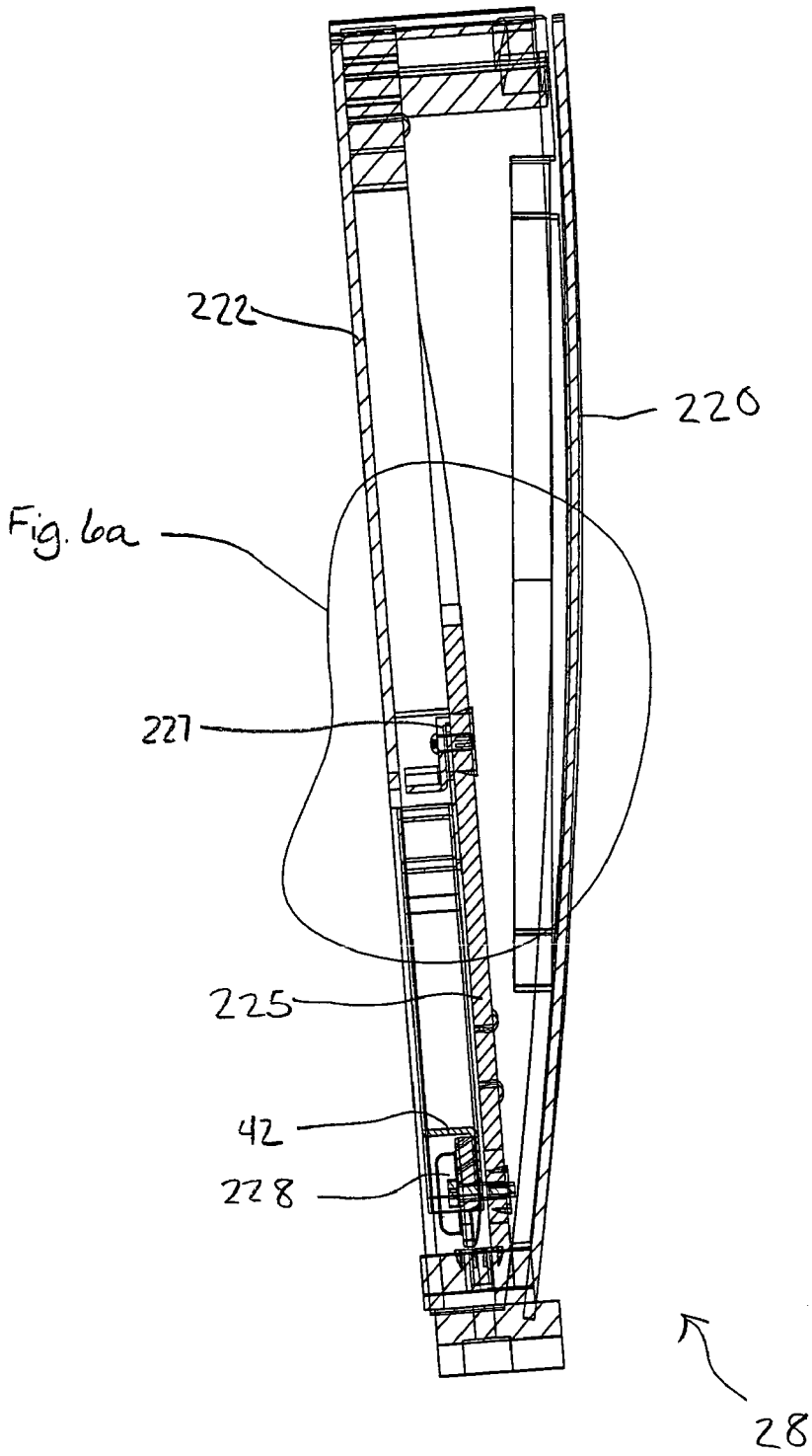
FIG. 6 is a cross sectional view of the left end section of the modular system of FIG. 1 assembled with the chassis.
Figure 10A:
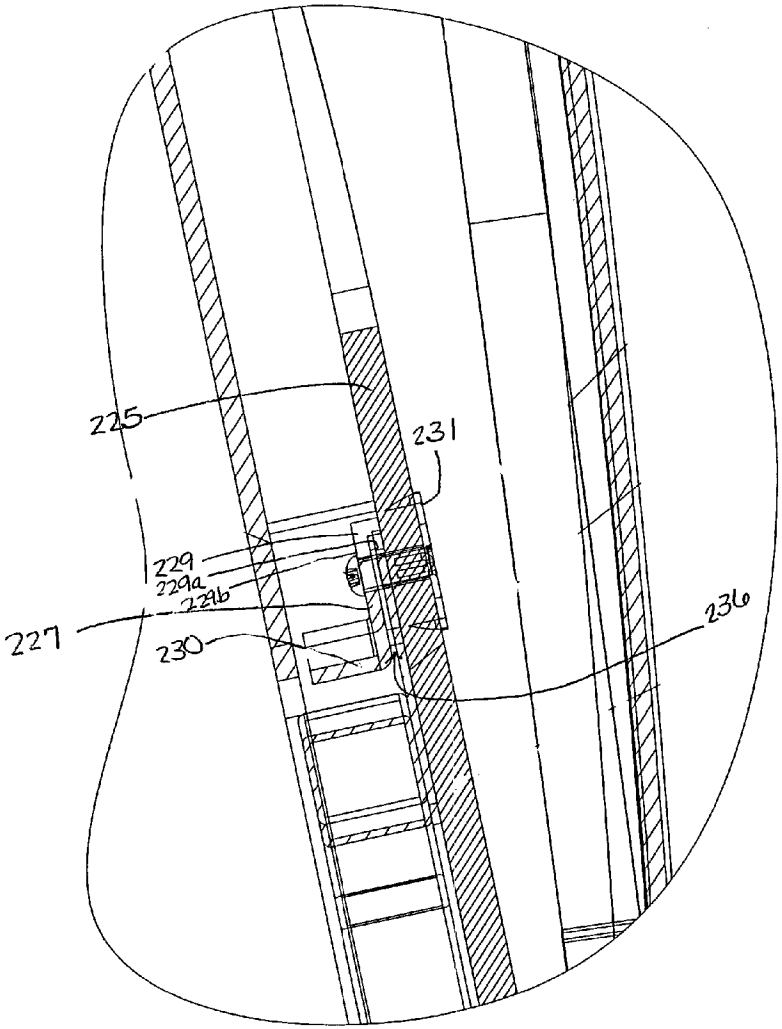
Figure 6B:
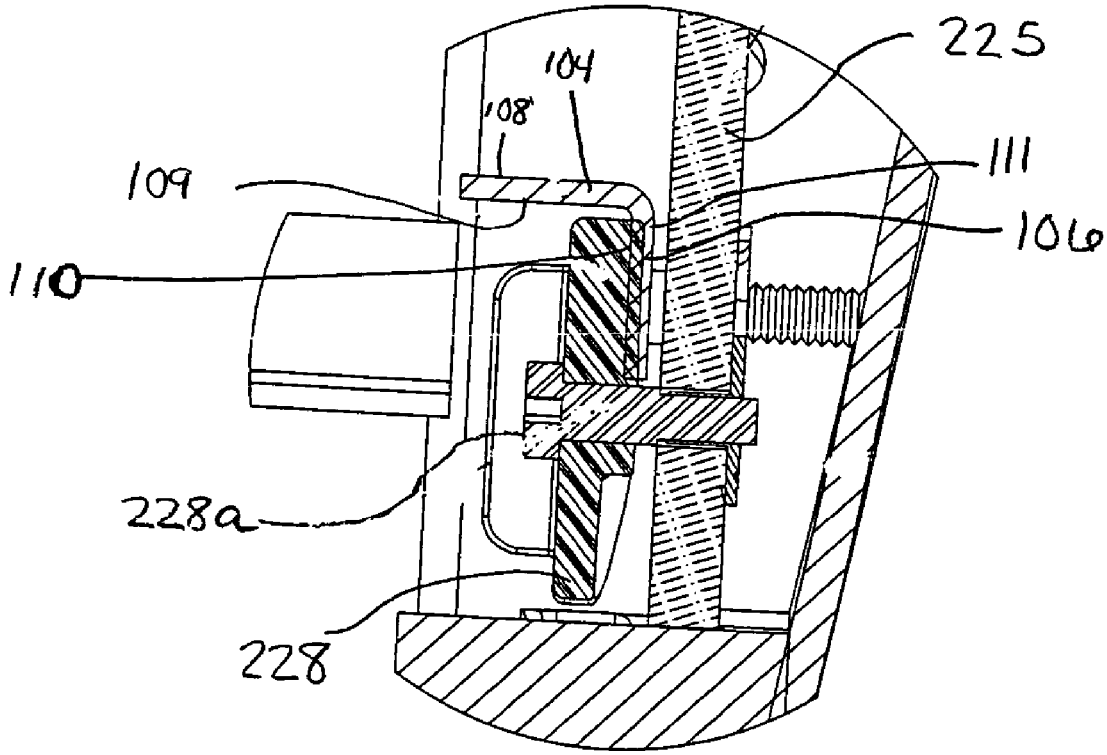
FIG. 6*b* is an enlarged view of a portion of FIG. 6.
Figure 8:
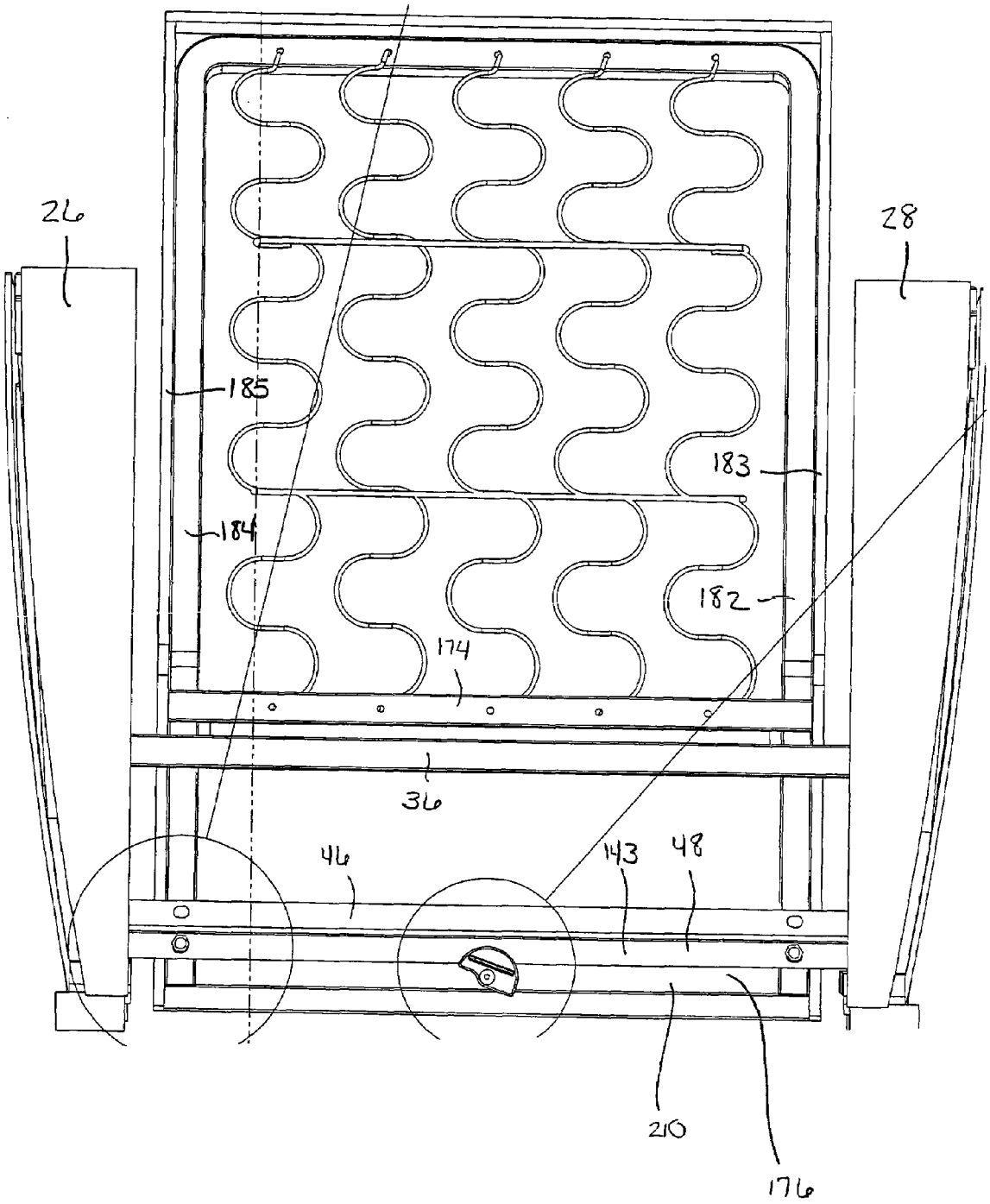
FIG. 8 is a front elevational view of assembled furniture system of FIG. 1 with the kick plate removed.

The right end section 26 is best shown in FIGS. 1, 4, 4*a* and 8 and the left end section 28 is best shown in FIGS. 6-6*b* and FIG. 8. The left end section 28 is a mirror image of the right end section 26. The end sections 26, 28 generally includes a shell 219, interior support members 221, base members 223, an inner plate 225, a foot 226, a cross bar/bracket 227 and cams 228.

Figure 4A:
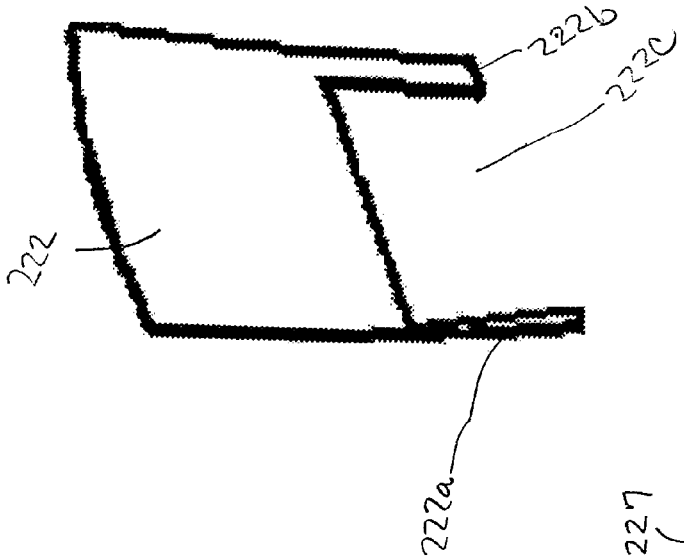
FIG. 4*a* is a perspective view of the inner plate of the right end section of the system of FIG. 1.
Figure 4:
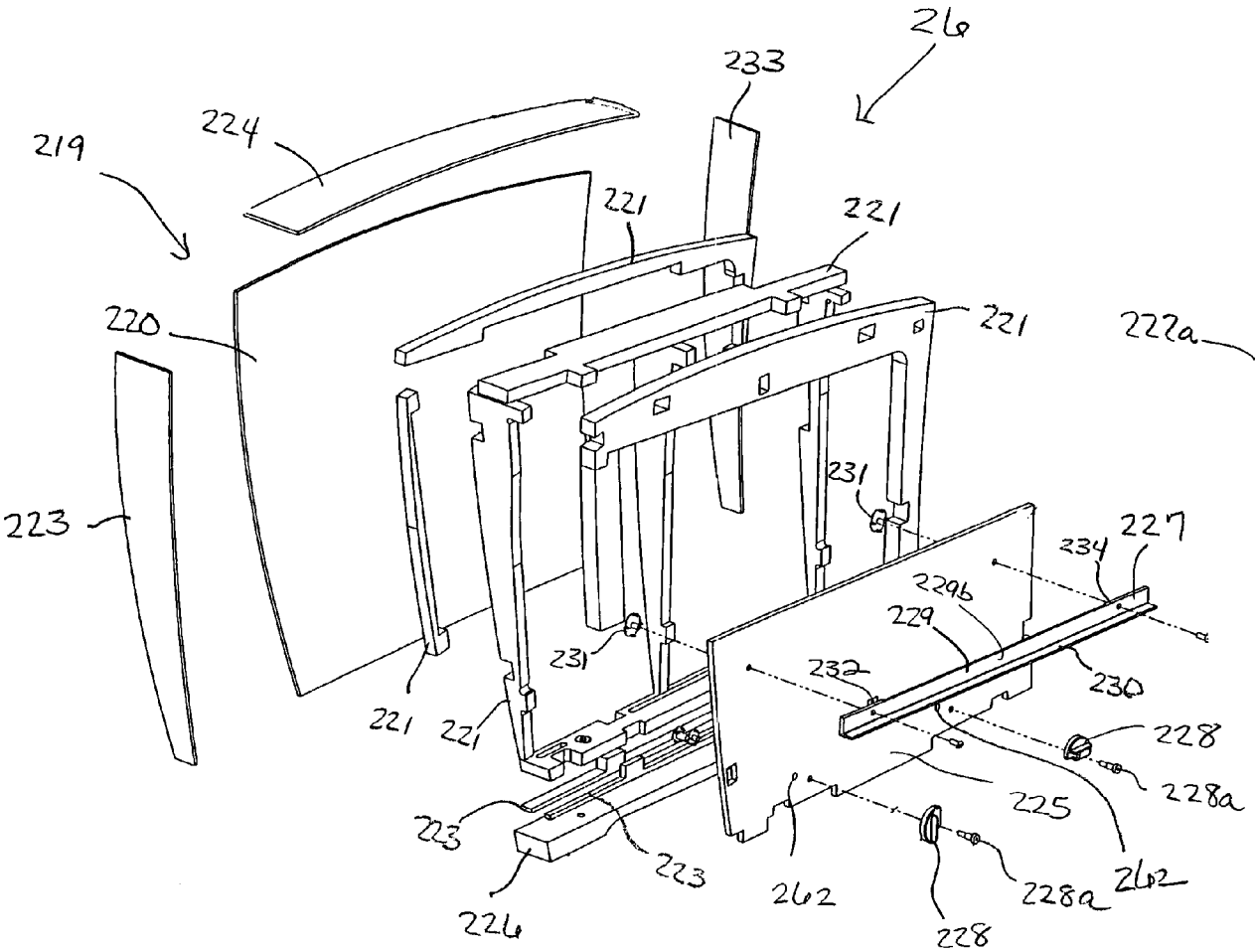
FIG. 4 is an exploded perspective view of a portion of the right end section of the system of FIG. 1.

The shell 291 of the end sections 26, 28 include an outer panel 220, an inner panel 222 (see FIG. 4*a*), a top panel 224, a front panel 223, and a rear panel 233. The shell 219 generally encloses the interior support members 221 of the end sections 26, 28. The outer panel 220 is generally planar. The inner panel 222 is also generally planar. As shown in FIG. 6, the outer panel 220 is angled relative to the inner panel 222. As shown in FIG. 4*a*, the inner panel 222 is also generally U-shaped to provide a front let 22*a* and a rear leg 222*b*. A notch 222*c* is provided between the front leg 22*a* and the rear leg 222*b* extending upwardly from the bottom edge of the inner panel 222. The top panel 224 is generally perpendicular to the inner panel 222 and extends between the upper edges of the inner panel 222 and the outer panel 220. The front panel 223 is generally perpendicular to the outer and inner panels 220, 222 and extends between the front edges of the outer and inner 220, 222 and extends between the rear edges of the outer and inner panels 220, 222.

The inner support members 221 are irregularly shaped and include notches and apertures for inter-engaging the inner support members 221. The inner support members 221 can be constructed of a variety of shapes and configurations. The base members 223 generally extend from the front of the end sections 26, 28 to the rear of the end sections 26, 28. An inner plate 225 is mounted within the shell 219 of each end section 26, 28 and is supported by the inner support members 221. The foot 226 is attached to the base members 223.

The cross bar/bracket 227 is generally L-shaped and includes a vertical portion 229 an a horizontal portion 230. The bracket 227 is mounted to the inner surface of the inner panel 225 through T-nuts 231. The vertical portion 229 of the bracket 227 includes an outer surface 229*a* and an inner surface 229*b*. The outer surface 229*a* of the vertical portion 229 of the bracket 227 is positioned proximate the inner surface of the inner plate 225. A front shoulder 232 extends inwardly from the outer surface 229*a* of the vertical portion 229 and a rear shoulder 234 extends inwardly from the outer surface 229*a* of the vertical portion 229 such that a gap 236 (see FIG. 6*a*) is provided between the bracket 227 and the inner plate 225. The notch 222*c* of the inner panel 222 provides access to the gap 236 for assembly of the chair as will be described herein.

Front and rear cams 228 are spaced apart and mounted to the inner plate 225 proximate the lower edge thereof. The cams 228 are provided to engage the chassis upon assembly of the chair as will be described herein.

Figure 5:
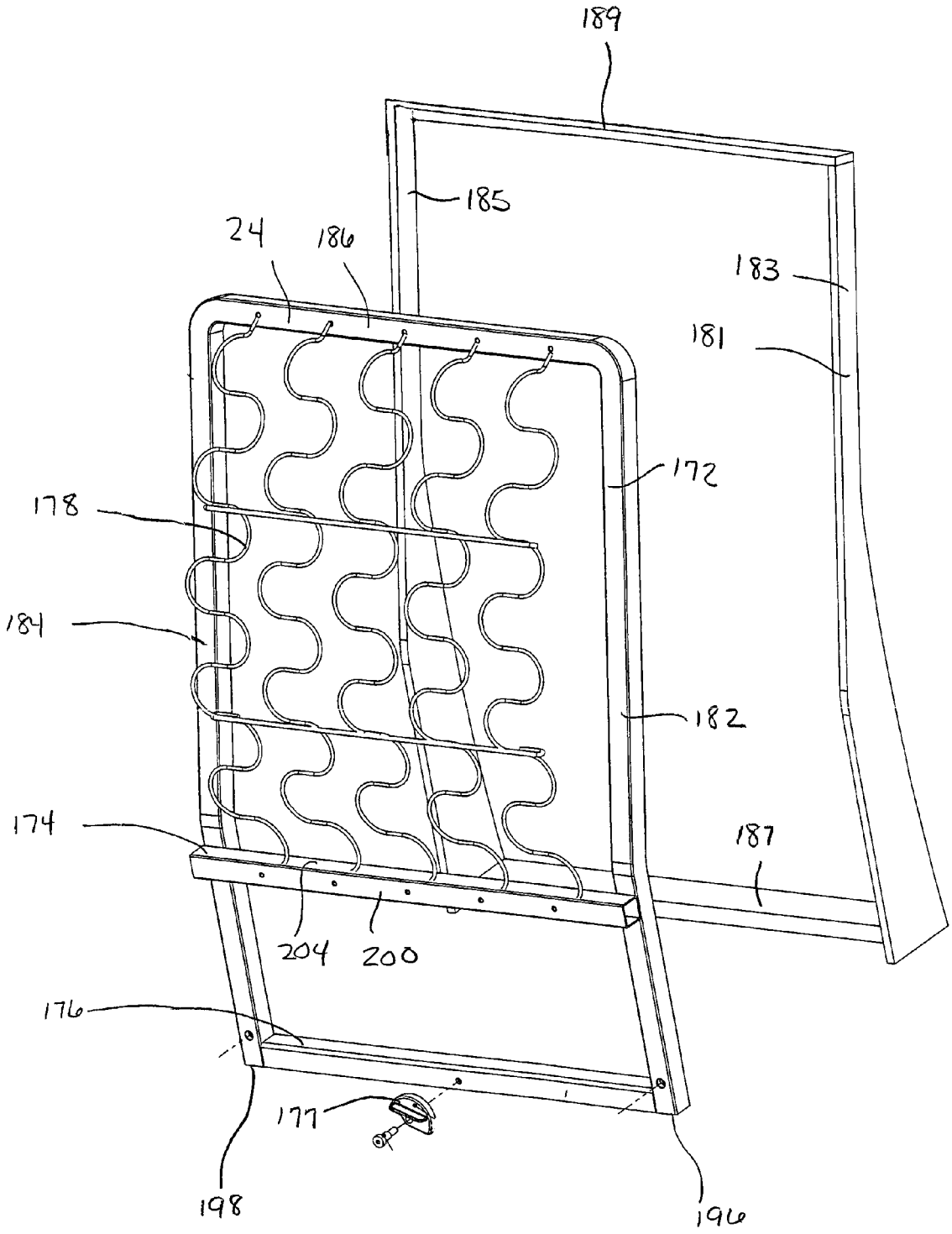
FIG. 5 is a perspective view of the back of the modular system of FIG. 1 along with a back shell.
Figure 5A:
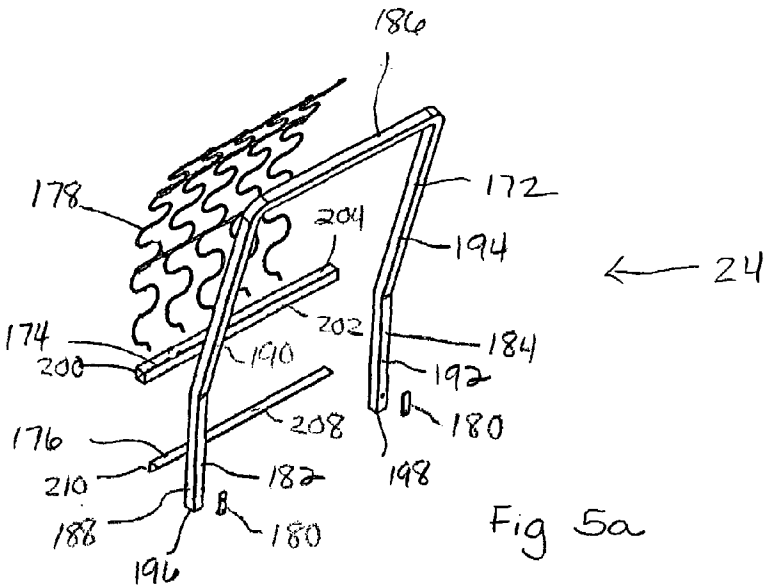
FIG. 5*a* is an exploded perspective view of the back of the modular system of FIG. 1.
Figure 5B:
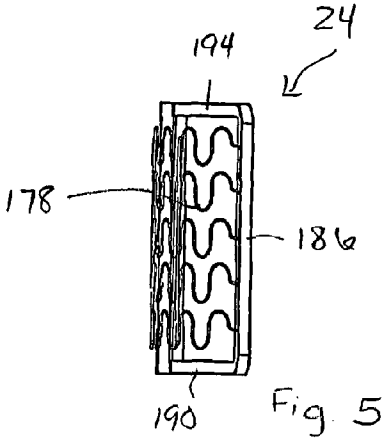
FIG. 5*b* is a top plan view of the back of the modular system of FIG. 1.

As shown in FIGS. 5-4*c*, the back 24 includes an upper support 172, an upper cross bar 174, a lower cross bar 176, springs 178, and weld nuts 180.

The upper support 172 is generally U-shaped and includes a left leg 182, a right leg 184, and a base portion 186 extending between the left leg 182 and the right leg 184. The upper support 172 is preferably formed from metal tubing having a square cross-section. The left leg 182 includes a lower portion 188 and an upper portion 190. The upper portion 190 is angled relative to the lower portion 188. The right leg 184 includes a lower portion 192 and an upper portion 194. The upper portion 194 is angled relative to the lower portion 192. The base 186 is generally perpendicular to the left and right legs 182, 184. Rounded corners are provided between the left and right legs 182, 184 and the base portion 186. A left free end 196 is provided at the lower end of the left leg 182 and a right free end 198 is provided at the lower end of the right leg 184.

An upper cross bar 174 extends from the outer surface of the left leg 182 and the outer surface of the right leg 184. The upper cross bar 174 is preferably formed from metal tubing having a square cross-section. The upper cross bar 174 has an front surface 200, a rear surface 202, an upper surface 204 and a lower surface 206. The upper cross bar 174 is attached to the lower portions 188, 192 of the left and right legs 182, 184 proximate the upper ends thereof. Preferably the upper cross bar 174 is attached to the left and right legs 182, 184 by welding the rear surface 202 of the upper cross bar 174 to the front surfaces of the lower portions 188, 192 of the left and right legs 182, 184.

Figure 5C:
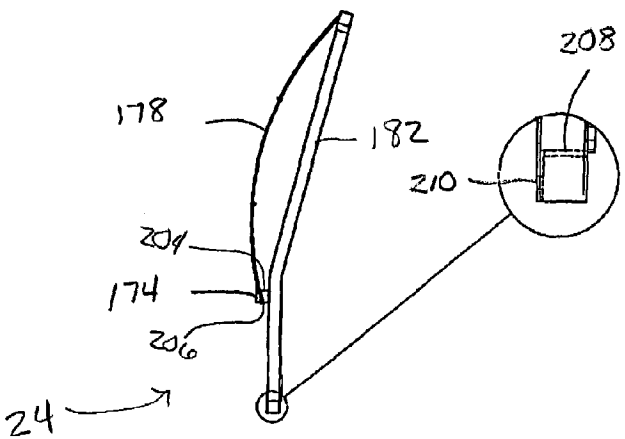
FIG. 5*c* is a left end view of the back of the modular system of FIG. 1.

A lower cross bar 176 extends from the inner surface of the left leg 182 to the inner surface of the right leg 184. The lower cross bar 176 is preferably formed from metal having an L-shaped cross-section. The lower cross bar 176 is spaced from the upper cross bar 174 and is positioned proximate the free ends 196, 198 of the left and right legs 182, 184. The lower cross bar 176 includes a horizontal member 208 having an upper surface and a lower surface and a vertical member 210 having a front surface and a rear surface. The cam 177 is mounted to the front surface of the vertical member 210 through a shoulder bolt. A plurality of springs 178 extends from the base portion 186 of the upper support 172 to the upper cross bar 174. As best shown in FIG. 5*c*, the springs 178 are mounted to provide a convex curve protruding from the upper portions 190, 194 of the left and right legs 182, 184.

The left weld nut 180 is provided on the rear surface of the lower portion 188 of the left leg 182 proximate the left free end 192. A right weld nut 180 is provided and the rear surface of the lower portion 192 of the right leg 184 proximate the right free end 198.

A shell 181 includes a left member 183, a right member 185, a lower member 187 and an upper member 189. The left and right members 185, 187 are generally parallel to each other and are generally perpendicular to the lower and upper members 187, 189. The shell 181 is mounted to the back 24 by placing the left and right legs 182, 184 of the back 24 against the left and right members 185, 187 of the shell 181.

Figures 9A, 9B, 9C, 9D:
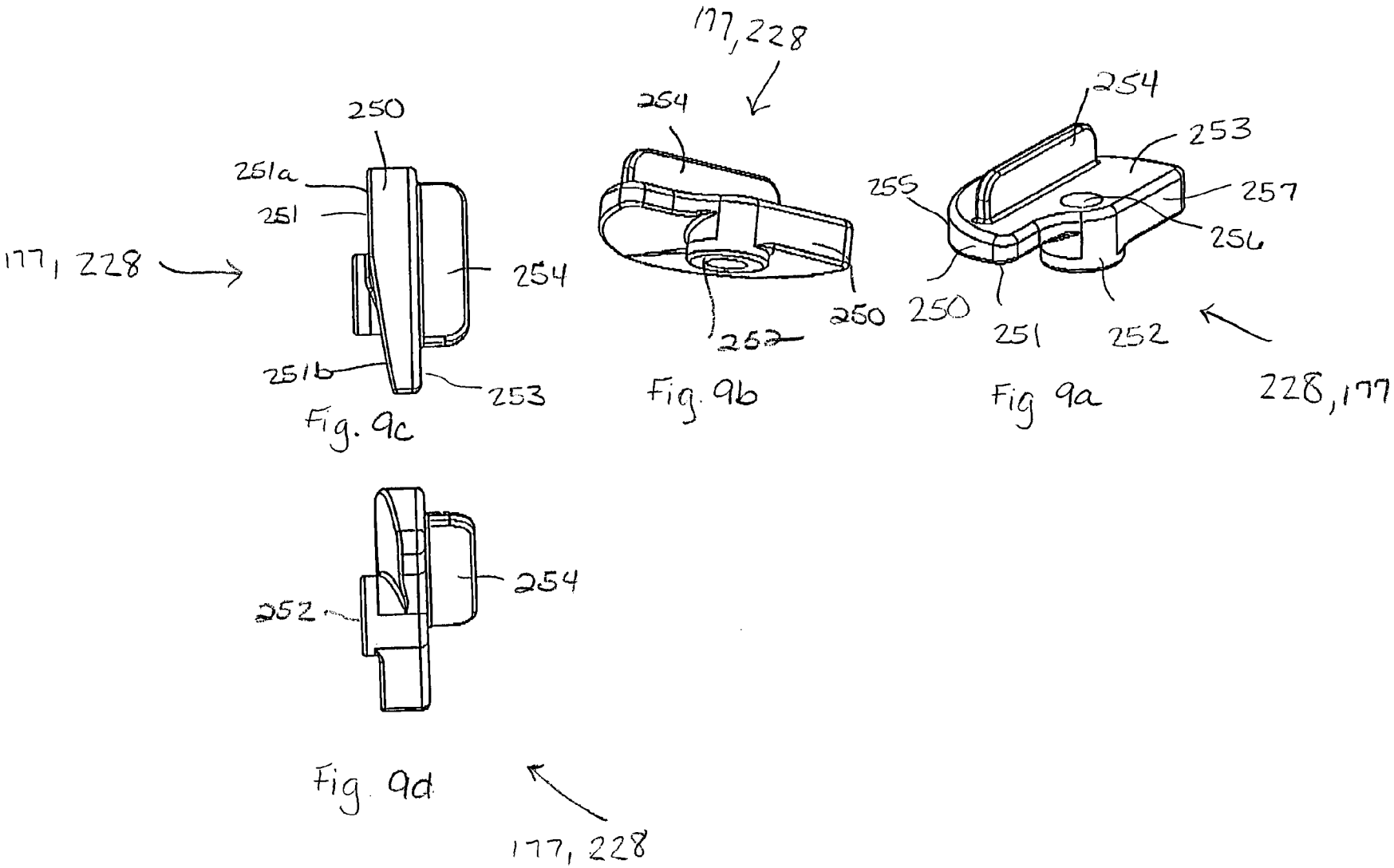
FIG. 9*a* is a perspective view of a locking cam.
FIG. 9*b* is perspective view of a locking cam.
FIG. 9*c* is a side elevational view of a locking cam.
FIG. 9*d* is a side elevational view of a locking cam.

As shown in FIG. 9*a*-9*d*, the cam 177, 228 include a body having a generally hemispherically shaped perimeter, a mounting member 252 extending from a first surface 251 of the body 250, and a handle 254 extending generally perpendicular to a second surface 253 of the body. The perimeter of the body 250 includes an arcuate portion 255 and a generally flat portion 257. An aperture 256 is provided through the body 250 and the mounting member 253 for mounting the cam 228 to the right end section 26. The cam 228 is mounted to the right end section 26 by placing a fastener through the aperture 256 and engaging the fastener with the recessed portion 230 of the right end section 26. The cam 228 is mounted so as to allow rotation of the cam 228 relative to the right end section 26. As shown in FIG. 9*c*, the first surface 251 of the cam 228 includes a first portion 251*a* and a second portion 251*b*. The second portion 251*b* is angled relative to the first portion 251*a*, such that width of the body 250 is smaller proximate the second portion 251*b* than the width of the body 250 proximate the first portion 251*a*.

The seat platform 29 is generally planar and rectangularly shaped. The seat platform 29 is dimensioned such that the platform extends from the inner surface 150 of the left side blade 50 to the inner surface 156 of the right blade 52 and from the inner surface of the rear blade beyond the rounded corners 84, 94 of the left and right side rails 38, 40. The seat platform 29 is preferably formed of wood and is mounted to the chassis using self drilling screws.

The kick plate 30 is generally rectangularly shaped. The kick plate 30 extends from the rounded corners 84, 94 of the left and right side rails 38, 40 to the free ends 88, 98 of the left and right side rails 38, 40 and from the outer surface of the left side rail 38 to the outer surface of the right side rail 40. The kick plate 30 also abuts the front surfaces of the vertical portions 82, 92 of the left and right side rails 38, 40. The kick plate 30 is preferably formed from wood.

Upholstery (not shown) is provided over the back frame 24 and the shell 181, the left and right end sections 26, 28, and the kick plate 30. Upholstery of the right and left end sections 26, 28 extends over the outer panel 220, the inner panel 222, the front panel 223, the top panel 224, the rear panel 233, and the base members 223. Preferably, velcro closures are provided on the upholstery proximate the base members 223. The velcro closures allow the upholstery to be easily removed from the end section 26, 28 for cleaning, repair, and/or replacement. The foot 226 is mounted to the base members 223. Upholstery is also provided over the back 24 and shell 181. Preferably, velcro closures are provided on the upholstery proximate the lower cross bar 176 of the upper frame 172 and the lower member 187 of the shell 181. The velcro closures allow the upholstery to be easily removed from the back 24 for cleaning, repair and/or replacement. Upholstery extends over the kick plate 30. The kick plate 30 is mounted to the chassis using self drilling screws.

Due to its modular construction, the chair 20 can be shipped in "knocked down" form. In its knocked down form, the chair 20 includes five components: a chassis assembly, three support components to be attached to the chassis, and a seat cushion (not shown). The chassis assembly includes the chassis 22, the seat platform 29, and the kick plate 30. The support components include the back 24, the right end section 26, the left end section 28.

Figure 7:
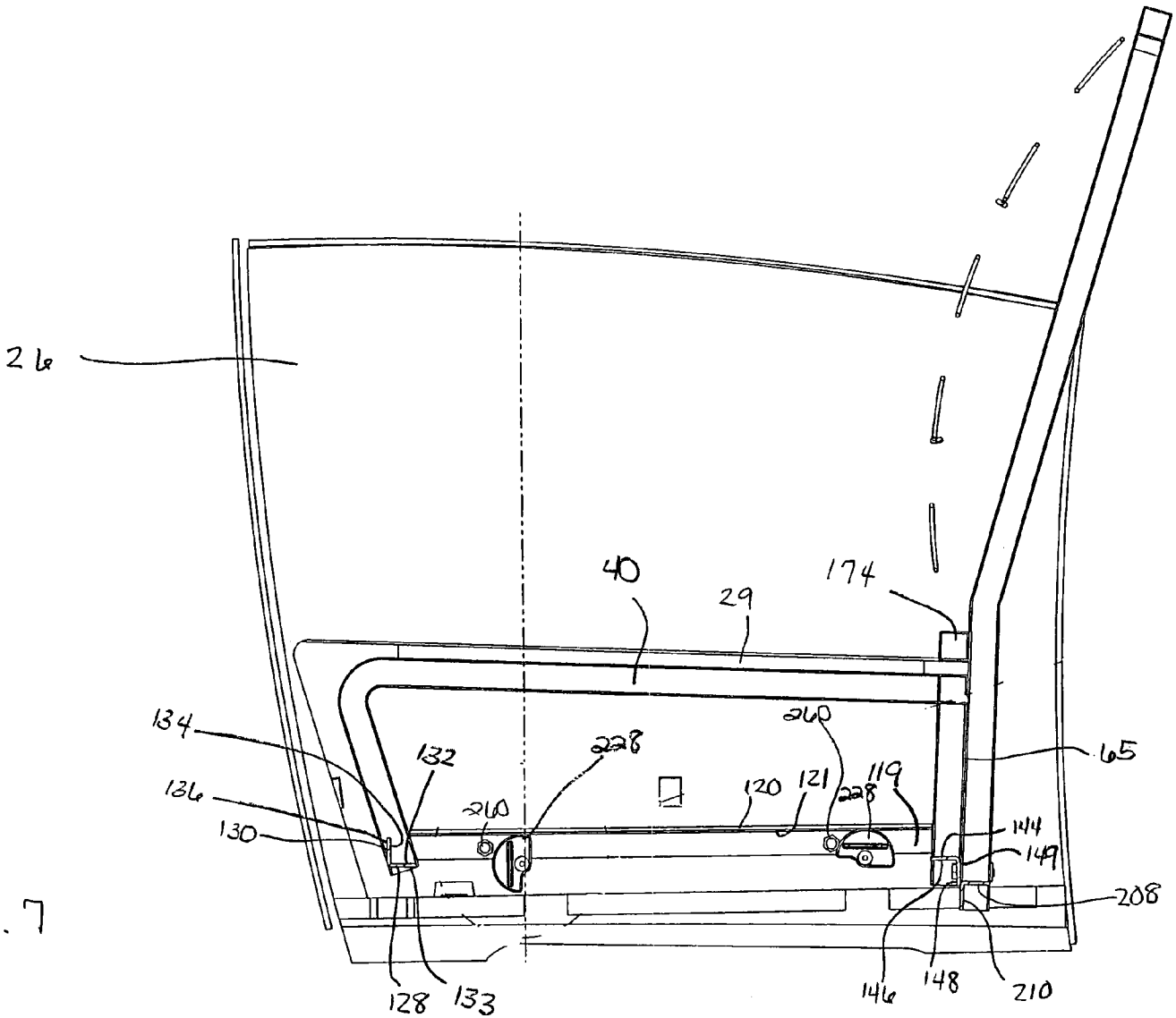
FIG. 7 is a cross-sectional view of the assembled furniture system.

Upon reaching its destination, assembly of the chair 20 is as follows. First the right end section 26 is placed on the floor such that the outer panel 220 of the shell 219 is planar with the floor. The assembler then ensures that the cams 228 are rotated to the unlocked position. In the unlocked position, the surface 257 of each cam 228 will be directed toward the bracket 227 and generally parallel to the bracket 227 of the right end section 26. Next, the user lifts and rotates the chassis assembly ninety degrees such that the seat platform 29 is vertical and the right side rail 40 is proximate the inner panel 222 of the right end section 26. The right blade 52 is then positioned over the notch 222*c* of the inner panel 222 of the right end section 26. The chassis 22 is then tilted such that the upper end 64 of the right corner post 34 and the corner 94 of the right side rail 40 are proximate the inner panel 222 of the right end section 26. The chassis is then lowered such that the right blade 52 passes between the front leg 222*a* and the rear leg 222*b* of the inner panel 222. The top edge of the right blade 52 is then positioned behind the vertical portion 229 of the bracket 227. The chassis 22 is then pushed upward such that the right blade 52 moves into the gap 236 between the bracket 227 and the inner plate 225. As the chassis 22 is pushed upward into the gap 236, the chassis 22 is also lowered/rotated such that right base 44 of the chassis 22 passes over cams 228 and the lower end 66 of the right corner post 34 and the lower end 98 of the right side rail 40 are positioned proximate the inner plate 225. As the chassis 22 is lowered/rotated the right blade 52 engages the bracket 227 of the right end section 26. Continued lowering/rotation of the chassis 22 causes the right blade 52 to flex outwardly. When the right base 44 is in its final position, the assembler rotates the cams 228 such that a portion of each cam 228 is positioned over the vertical portion 118 of the right base 44, as shown in FIG. 7. Upon setting the chair 22 upright, the right blade 52 provides an inwardly directed force on the bracket 227 of the right end section 226 causing the right end section 26 to rotate such that the foot 226 of the right end section 26 will swing outwardly. Rotation of the right end section 26 is prevented, however, due the engagement between the cams 228 and the right base 44. Thus, an interference fit is provided between the right end section 26 and the chassis 22. The gauge of metal used to form the right blade 52 is selected such that the blade 52 provides a yielding force which is counteracted by the force of the cams 228 on the right base 44. Preferably 14 gauge steel is used to form the blade 52. This interference fit eliminates movement between the chassis 22 and the right end section 26 providing a firm engagement between the components.

Next, the assembler lays the left end section 28 on the floor such that the outer panel 220 of the end section 28 is planar with the floor. The user then lifts the chassis assembly with the right end section 26 mounted to the chassis and rotates the chassis and right end section 26 such that the seat platform 29 is vertical and the left side rail 38 of the chassis 22 is proximate the inner panel 222 of the left end section 28. The chassis 22 and the right end section 26 are then mounted to the left end section 28 in the same manner as mounting the right end section 26 to the chassis 22.

Next the assembler sets the chassis 22 upright such that the feet 226 of the right and left end sections 26, 27 rest upon the floor. As shown in FIG. 6*a* when the chassis 22 is set upright, the vertical portion 106 of the left base 42 will rest on the shoulder bolts 228*a* which secure the cams 228 to the inner plate 225 of the left end section 28. Likewise, the vertical portion 118 of the right base 44 will rest on the shoulder bolts 228*a* which secure the cams 228 to the inner plate 225 of the right end section 26.

To assemble the back 24 to the chassis 22 the assembler then ensures that the cam 177 of the back 24 is rotated to the unlocked position. In the unlocked position, the surface 257 of the cam 177 is generally parallel to the lower cross bar 176 of the back 24. The back 24 along with the shell 181 is then lifted and aligned with the chassis 22 such that the left and right legs 182, 184 of the upper support member 172 are positioned proximate the left and right corner posts 32, 34 of the chassis 22 and the upper cross bar 174 of the upper support 172 is positioned above the rear blade 54. The back 24 along with the shell 181 is then tilted such that the free ends 196, 198 of the left and right legs 182, 184 are moved away from the chassis 22. The upper cross bar 174 is then positioned in front of the rear blade 54 and the back 24 is lowered to allow the upper cross bar 174 to rest on the upper surface of the seat platform 29. As the back 24 is lowered, the back 24 is rotated to an upright position in which the free ends 196, 198 of the left and right legs 182, 184 abut the rear base 48 of the chassis 22. As the back 24 is rotated to the upright position, the cam 177 passes under the rear base of the chassis 22 and the rear blade 54 of the chassis 22 flexes rearwardly due to the engagement between the upper cross bar 36 with the rear blade 54. To obtain alignment between the lower cross bar 176 and the rear base 48, the assembler must overcome the yielding force provided by the rear blade 54. Once the lower cross bar 176 is aligned with the rear base 48, the assembler reaches under the chassis 22 and rotates the cam 177 to secure the back 24 to the chassis 22. When the cam 177 is in its locked position, the rear blade 54 is flexed. The gauge of the metal used to form the rear blade 54 is selected such that an interference fit is provided between the chassis 22 and the back 24. Preferably 14 gauge steel is used to form the rear blade 54. This interference fit is provided by the yielding force of the blade 54 which urges the upper cross bar 174 forward and the counteracting force of the cam 177 which prevents the lower cross bar 176 from moving rearwardly away from the rear base 48. The interference fit eliminates movement between the chassis 22 and the back 24 to provide a secure fit between the components.

Finally the seat cushion (not shown) is placed ever the seat platform 29.

If the chair is to be used in a setting in which it is desired that the chair be more difficult to disassemble, rather than using cams 177, 228, bolts can be used to secure the left and right end sections 26, 28 and the back 24 to the chassis 22. In this instance, assembly of the chair is similar to the assembly described above. When mounting the right end section 26 to the chassis 22, however, bolts 260 (see FIG. 2)

are passed through the mounting apertures 118 of the right base 44 and into the apertures 262 provided through the inner plate 225 of the right end section 26. When mounting the left end section 28 to the chassis 22, bolts are passed through the mounting apertures 107 of the left base 42 and into the apertures in the inner plate 225 of the left end section 28. When mounting the back 24 to the chassis 22, bolts 260 are passed through the mounting apertures 145 of the rear base 48. Assembly of the components using bolts 260 requires the use of a tool. In the same manner, disassembly of the components also requires the use of tools and therefore makes disassembly more difficult. A more difficult disassembly may be desirable when the chair is to be used in an environment where theft and/or vandalism are a concern.

As can be understood from the above description, the components of the chair 20 can be shipped cost efficiently. In addition, no tools or special skills are required to assemble the components of the chair 20. Assembly merely requires alignment of the components and rotation of the cams. If it is desired, however, to make disassembly of the chair 20 more difficult, bolts can be used to assemble the components of the chair 20. In the event a particular component becomes damaged, it is not necessary to discard the entire chair 20. Rather, the particular component can be removed and replaced.

While use of the modular structure has been shown in the drawings in connection with a chair 20. It is to be understood that a similar structure could be used in connection with other items of furniture, for example, a love seat or a couch. In addition, modifications can be made to the shape and dimensions of the structure to provide different designs or styles to the furniture.

While preferred embodiments of the invention are shown and described, it is envisioned that those skilled in the art may devise various modifications of the present invention without departing from the spirit and scope of the appended claims.

The invention claimed is:

1. A modular furniture system comprising:

a chassis, said chassis including a rail and a blade extending upwardly from said rail;

a support component including a cross bar engaged with said blade of said chassis;

means for releasably locking the chassis and the support component together;

wherein said support component is an end section;

wherein said chassis further includes a base positioned below said rail and said locking means are mounted to said end section for engagement with said base; and wherein said locking means is a cam which is rotatably engaged with said base.

2. A modular furniture system comprising:

a chassis, said chassis including a rail and a blade extending upwardly from said rail;

a support component including a cross bar engaged with said blade of said chassis;

means for releasably locking the chassis and the support component together;

wherein said support component is an end section;

wherein said chassis further includes a base positioned below said rail and said locking means are mounted to said end section for engagement with said base;

wherein said locking means is a cam which is rotatably engaged with said base; and wherein said end section includes an inner plate and said cam is mounted to said inner plate of said end section.

3. A modular furniture system comprising:

a chassis, said chassis including a rail and a blade extending upwardly from said rail;

a support component including a cross bar engaged with said blade of said chassis;

means for releasably locking the chassis and the support component together;

wherein said support component is a back and said blade of said chassis is positioned behind said cross bar;

wherein said chassis further includes a rear base positioned below said rail;

said back further includes a lower cross bar positioned below said cross bar;

said rear base of said chassis is engaged with said lower cross bar of said back; and wherein said locking means is provided by a cam mounted to said back and wherein said cam engages said rear base of said chassis.

4. A modular furniture system comprising:

a chassis, said chassis including a rail and a blade extending upwardly from said rail;

a support component including a cross bar engaged with said blade of said chassis;

means for releasably locking the chassis and the support component together;

wherein said support component is a back and said blade of said chassis is positioned behind said cross bar;

wherein said chassis further includes a rear base positioned below said rail;

said back further includes a lower cross bar positioned below said cross bar;

said rear base of said chassis is engaged with said lower cross bar of said back;

wherein said locking means is provided by a cam mounted to said back and wherein said cam engages said rear base of said chassis; and wherein said cam is mounted to said lower cross bar of said back.

* * * * *

UNITED STATES PATENT AND TRADEMARK OFFICE

CERTIFICATE OF CORRECTION

PATENT NO. : 7,240,967 B2
APPLICATION NO. : 10/893624
DATED : July 10, 2007
INVENTOR(S) : Donald L. Wade It is certified that error appears in the above-identified patent and that said Letters Patent is hereby corrected as shown below:

On the title page
(73) Assignee: "Weiland Designs, Inc." should be
-- Wieland Designs, Inc. --

Signed and Sealed this

Sixth Day of November, 2007

JON W. DUDAS
*Director of the United States Patent and Trademark Office*